US006175266B1

(12) United States Patent
Sharpe-Geisler

(10) Patent No.: US 6,175,266 B1
(45) Date of Patent: Jan. 16, 2001

(54) OPERATIONAL AMPLIFIER WITH CMOS TRANSISTORS MADE USING 2.5 VOLT PROCESS TRANSISTORS

(75) Inventor: Bradley A. Sharpe-Geisler, San Jose, CA (US)

(73) Assignee: Vantis Corporation, San Jose, CA (US)

( * ) Notice: Under 35 U.S.C. 154(b), the term of this patent shall be extended for 0 days.

(21) Appl. No.: 09/207,558

(22) Filed: Dec. 8, 1998

Related U.S. Application Data

(60) Provisional application No. 60/079,705, filed on Mar. 27, 1998.

(51) Int. Cl.[7] ..... G05F 3/02
(52) U.S. Cl. ..... 327/541; 327/359
(58) Field of Search ..... 327/563, 359, 327/541, 543, 546; 375/354, 356

(56) References Cited

U.S. PATENT DOCUMENTS 5,276,368 * 1/1994 Kimura et al. ..... 307/522
5,818,884 * 10/1998 Reymond ..... 375/354
5,909,136 * 6/1999 Kimura ..... 327/356
5,966,035 * 10/1999 Lien ..... 327/89

* cited by examiner

*Primary Examiner*—Kenneth B. Wells
*Assistant Examiner*—Linh Nguyen
(74) *Attorney, Agent, or Firm*—Fliesler, Dubb, Meyer & Lovejoy

(57) ABSTRACT

A power converter includes an opamp (FIG. 5) with CMOS transistors made using 2.5 volt process technology which tolerates a maximum gate voltage of 2.7 volts. The opamp is driven by a pin supply voltage (NV3EXT) with a maximum value of 3.6 volts. The connection of the transistors of the opamp (FIG. 5) provides a maximum gate to source, and gate to drain voltage on each transistor which is less than 2.7 volts when NV3EXT is at 3.6 volts. Further, the output (OUT) of the opamp (FIG. 5) is referenced to ground, rather than NV3EXT to prevent fluctuations in the input voltage offset relative to NV3EXT, and minimize variations in the output voltage margin of the power converter.

9 Claims, 4 Drawing Sheets

OPERATIONAL AMPLIFIER WITH CMOS TRANSISTORS MADE USING 2.5 VOLT PROCESS TRANSISTORS

CROSS-REFERENCE TO RELATED APPLICATION

This application claims the benefit of U.S. Provisional Application No. 60/079,705, filed Mar. 27, 1998.

BACKGROUND OF THE INVENTION

1. Field of the Invention

The present invention relates to a power converter using an operational amplifier, the power converter for providing a stable voltage supply to a plurality of transistors on an integrated circuit. More particularly, the present invention relates to a power converter made using 2.5 volt process transistors.

2. Description of the Related Art

FIG. 1 shows a typical circuit for a power converter for providing a voltage Vdd of 2.5 volts to components on an integrated circuit chip made using a 2.5 volt process. CMOS transistors made using such a 2.5 volt process typically have a limit of 2.7 volts for a gate to drain, or gate to source voltage before damage to the transistor gate oxide occurs. An typical 2.5 volt process transistor has a gate length of 0.25 microns or less and an oxide thickness of 60 Angstroms or less.

The circuit of FIG. 1 includes an operational amplifier (opamp) 100 which has a noninverting input (+) connected to a diode voltage reference ($V_{DIOD}$), typically 1.2 volts, and an inverting input (−) connected to a resistor divider made up of resistors 102 and 104. Power is provided to the opamp 100 from an external supply pin (NV3EXT) providing a voltage in the range of 3.0 to 3.6 volts. The output of the opamp 100 then drives the gate of an NMOS transistor 110.

The voltage $V_{DIOD}$ can be provided from a conventional voltage reference, such as a band gap reference. Such a reference circuit included with the power converter of FIG. 1 forms a voltage regulator.

The transistor 110 has a drain connected to the NV3EXT supply and a source providing the supply voltage Vdd. The supply voltage Vdd is divided by the resistor divider 102, 104 so that the voltage at node n matches the diode reference voltage $V_{DIOD}$. Transistor 110 is a large device, and is connected to subsequent components in a source follower configuration. The large transistor 110 experiences a more significant change in its drain to source current (Ids) with a change in gate voltage than a smaller device.

In operation, when a load is placed on the node n2, which pulls down Vdd, the inverting (−) input of the opamp 100 will drop, and the opamp 100 output voltage will increase and turn on transistor 110 to provide more current to node n2 to raise Vdd back to the desired level.

A large capacitor 112 is connected to the gate of transistor 110 to decouple the gate of transistor 110 from its source. With a significant drop in the source voltage of transistor 110, without capacitor 112, the gate will tend to be pulled down with the source until the opamp 100 has had time to increase the gate voltage to pull the source of transistor 110 back up. The capacitor 112 limits the speed that the gate of transistor 110 can be pulled down and provides stability to the circuit of FIG. 1.

FIG. 2 illustrates how the voltage Vdd at node n2 and the drain to source current of transistor 110 are affected when a load is placed on node n2. Initially the load is assumed to draw 5 milliamps, and the voltage Vdd remains stable at 2.5 volts. When the load is applied to node n2 which is assumed to draw 500 ma, the current Ids of transistor 110 immediately increases to provide the 500 milliamps, and the voltage Vdd initially reduces to approximately 2.2 volts before the opamp 100 can react to increase the gate voltage to transistor 110. Once the opamp 100 increases the gate voltage to transistor 110, the voltage Vdd increases back from 2.2 volts to 2.5 volts. Similarly, when the 500 ma load is removed, the current Ids will immediately return to 5 ma, but the gate voltage on transistor 110 will not be reduced for a short period of time by the opamp 100 so the voltage Vdd initially increases to approximately 2.8 volts. Once the opamp 100 decreases the gate voltage to transistor 110, the voltage Vdd decreases back from 2.8 volts to 2.5 volts. With Vdd increasing to 2.8 volts and a maximum of 2.7 volts between the gate and source, or gate and drain of transistor 110 damage to the gate oxide of transistor 110 can occur.

In addition to transistor 110, it is desirable for the remaining transistors of the power converter to operate with a maximum gate to source, or gate to drain voltage less than 2.7 volts. In particular it would be desirable to have a power converter with circuitry for the opamp 100 which uses 2.5 volt process transistors and delivers a 3.3 volt signal from a lead pin to other circuitry without damaging transistor gate oxide.

SUMMARY OF THE INVENTION

In accordance with the present invention, a power converter is provided with a CMOS opamp circuit made using 2.5 volt process transistors. The power converter can deliver a 2.5 volt supply while being powered from a supply pin delivering a maximum of 3.6 volts. Gate to source, and gate to drain voltages of transistors of the power converter will do not exceed 2.7 volts when the pin supply reaches the maximum of 3.6 volts.

The opamp of the power converter is configured to have its output referenced to ground so that a limited drift in its input offset voltage occurs with variations in the pin supply voltage. With an output voltage referenced to the pin supply voltage, the input offset voltage of an opamp will vary with changes in the pin supply voltage, so that a power converter using the opamp will have a reduced margin for safety between its output voltage and ground. With a reduced margin of safety, oxide damage can result in 2.5 volt transistors driven by the power converter.

BRIEF DESCRIPTION OF THE DRAWINGS

Further details of the present invention are explained with the help of the attached drawings in which.

DETAILED DESCRIPTION

Figure 1:
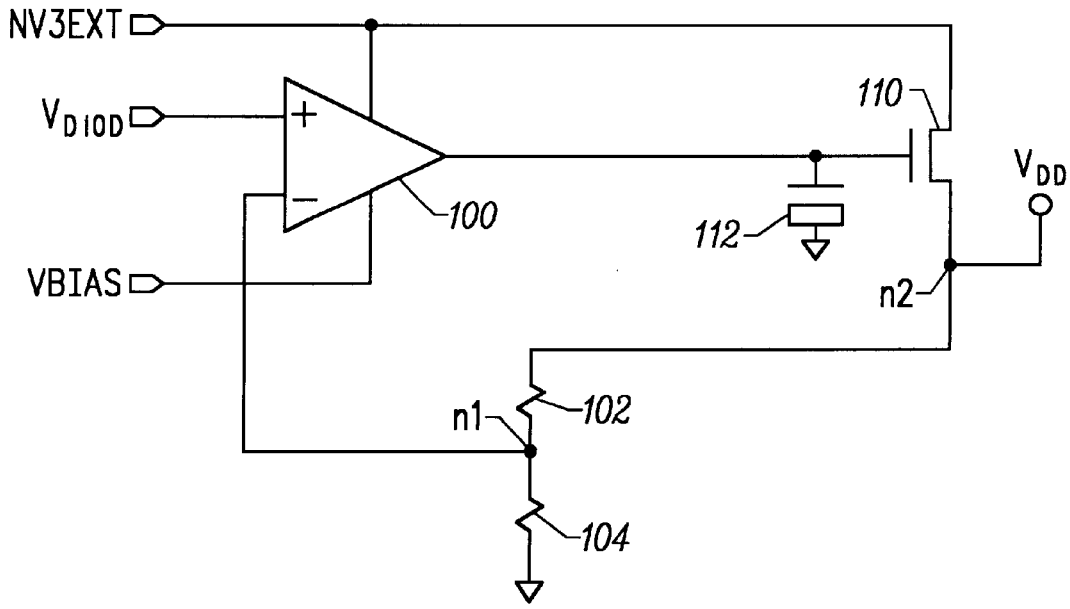
FIG. 1 (Prior Art)
FIG. 1 shows components of a prior art power converter.
Figure 2:
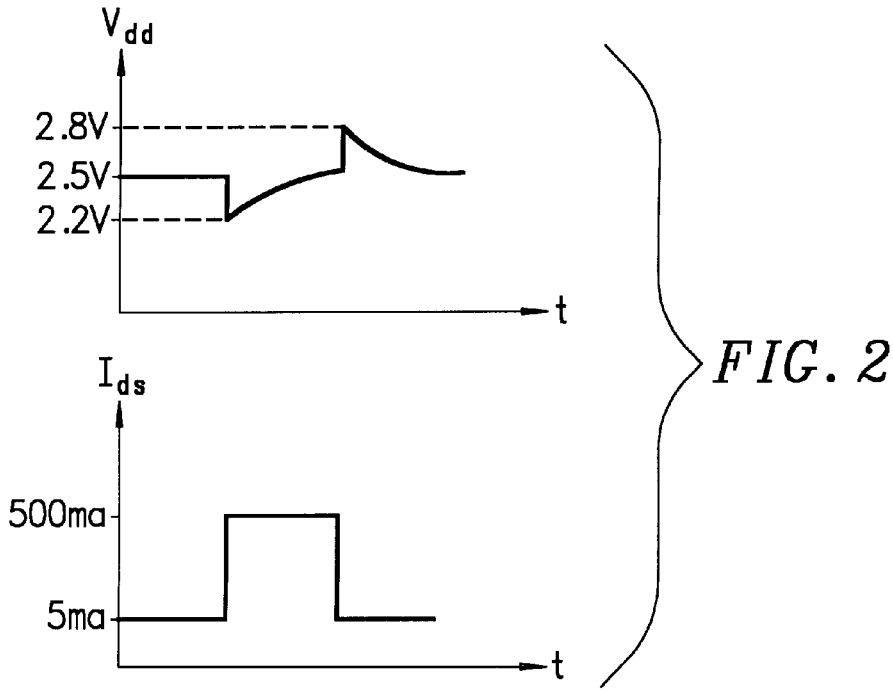
FIG. 2 plots voltage Vdd at node n2 vs. time and Ids of transistor 110 vs. time for the circuit of FIG. 1 when a load is applied and removed from node n2.
Figure 3:
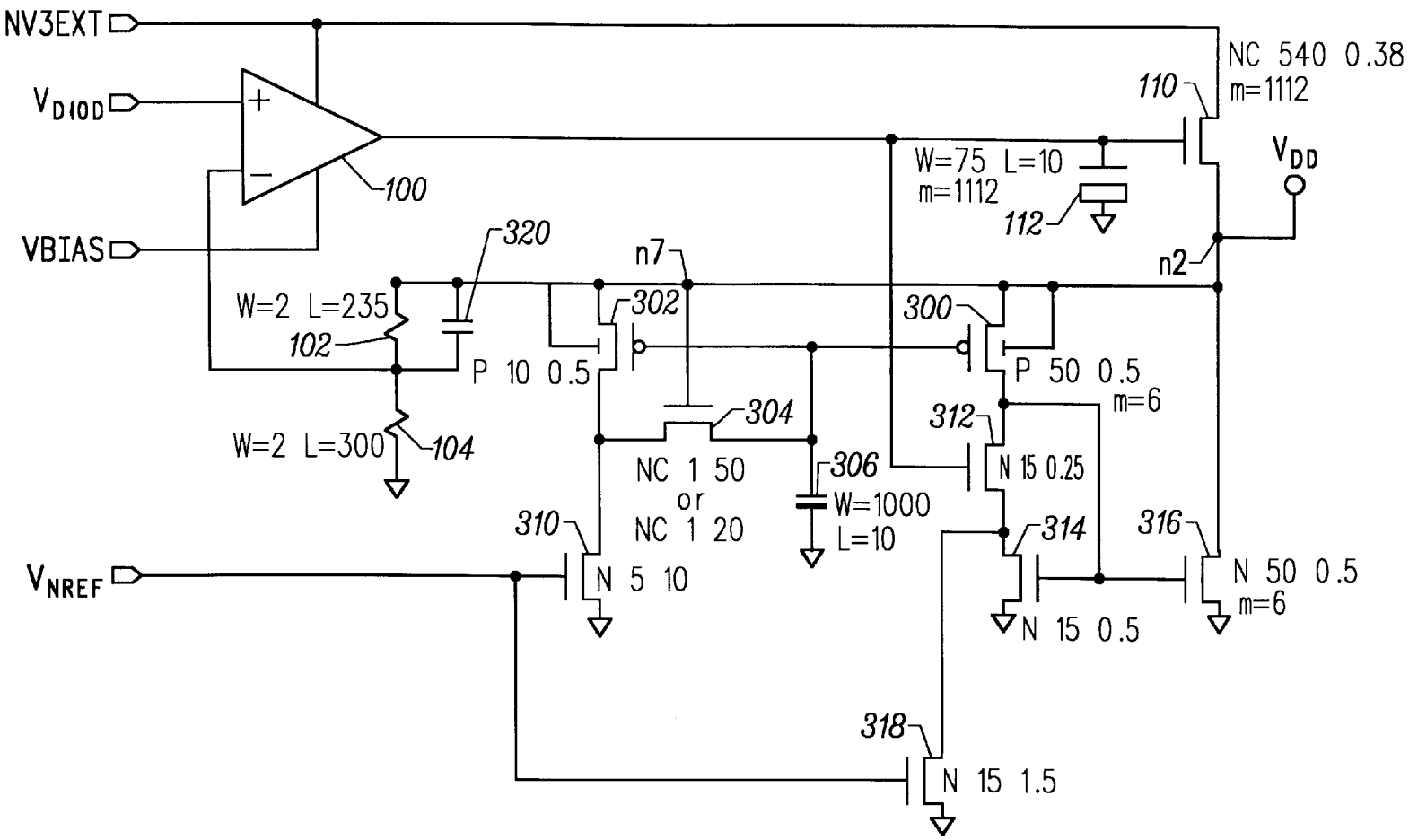
FIG. 3 shows components of a power converter of the present invention.

FIG. 3 shows circuitry added to the power converter of FIG. 1 to provide the power converter of the present invention with a more limited swing in Vdd. Components carried over from FIG. 1 to FIG. 3 have the same reference numbers.

FIG. 3 includes a PMOS cascode transistor 300. A cascode transistor is a transistor defined by being turned on and off by varying voltage applied to the source with the gate voltage substantially fixed, rather than varying the gate voltage. In a PMOS cascode transistor with $(v_s-v_g)>v_t$, wherein $v_g$ is the gate voltage, $v_s$ is the source voltage, and $v_t$ is the threshold voltage of the transistor, the cascode transistor will turn on and increase current depending on the amount $v_s-v_g$ exceeds $v_t$. With $(v_s-v_g)<v_t$, the cascode transistor will turn off.

With transistor 300 being a cascode connected device, if node n2 is pulled up when a load is removed from the node n2, transistor 300 turns on to sink current from node n2. Cascode 300, thus, serves to limit how high the voltage Vdd can go when a load is removed from node n2.

Transistor 310 has a gate driven by a current reference voltage $V_{NREF}$ which turns on transistor 310 to provide a small amount of current, such as 1 microamp. Transistors 300 and 302 form a current mirror. The gates of transistors 300 and 302 are connected together. The drain of transistor 302 is coupled to its gate and to the gate of transistor 300 at a node n7 by transistor 304. Transistor 304, along with capacitor 306 puts in a RC time constant so that the current mirror 300,302 responds slowly.

For the transistors shown in FIG. 3, and in subsequent drawings, a suggested channel type and transistor dimensions are indicated next to the transistor with a p or n indicating channel type followed by channel width and length in microns. An indication (m=6, m=2, m=3, m=1112) after the channel length indicates that a number of transistors are connected in parallel to effectively form a single larger transistor. For resistors and capacitors, a suggested width and length are likewise shown. Transistor sizes and types are only suggested and may be changed to meet particular design requirements.

The value "NC" associated with transistor 304 (and although not shown also preferably included with transistor 110) indicates the transistor is a depletion mode device. The transistor 304 is made a depletion mode device by adding additional n type implantation in its channel, such as by implanting phosphorous, to create a high resistance from its source to drain. The transistor 110 is also preferably a depletion mode device to assure NV3EXT is adequate to provide Vdd. The amount of implantation in transistor 110 is adequate to create a Vgs turn on voltage of −0.3V. If transistor 110 were an enhancement device, its source voltage of 2.5 volts plus an NMOS threshold voltage of approximately 0.7 volts would be needed at its gate to turn it on, totaling 3.3 volts. With the gate voltage on transistor 110 being 3.3 volts, a gate to source voltage greater than 2.7 volts can result which could damage capacitor 112 which is a 2.5 volt process device.

Transistor 300 is made up of six transistors (m=6) each with a channel width of 50 microns, while transistor 302 has a 10 micron channel width, indicating that transistor 300 is essentially 30 times larger. With such channel widths, transistor 300 will sink 30 times more current than transistor 302. If node n2 rises above a steady state value of 2.5 volts for Vdd, transistor 300 will sink a lot more current than transistor 302.

Transistors 314 and 316 form a current mirror. Transistor 300 is connected by a source to drain path of transistor 314 to the drain of NMOS transistor 314. Transistor 316 is 20 times larger than transistor 314. When node n2 goes above steady state, transistors 300, 302 and 316 turn on, and transistor 316 sources 600 times (30×20=600) more current than transistor 302. Transistor 316, thus, functions to significantly limit the amount node n2 is pulled up in voltage when a load is removed, and can respond more rapidly than the opamp 100 without transistor 300 connected in a cascode configuration to node n2 and high gain provided to the gate of transistor 316. High gain results from gain through the cascode transistor 300 and the gain through the current mirror since transistor 316 is 20 times larger than transistor 314.

Transistor 312 has a source and drain separating the cascode 300 and transistor 314 of the current mirror, and has a gate connected to the output of the opamp 100. Transistor 312 is normally on, but serves to turn off when a very low voltage is provided on the output of the opamp 100 to provide over voltage protection. Transistor 314 which can only sink a minimal amount of current. With transistor 312 off, the voltage at the drain of transistor 300 will increase to turn on transistor 316 even more strongly to rapidly discharge node n2.

Transistors 310 and 318 are used to control quiescent current so limited power is drawn when Vdd is stable. Transistors 310 and 318 have a gate voltage $V_{NREF}$ set so they are turned on to a limited degree. Transistor 318 removes current which would be drawn by transistor 314 so that transistor 316 doesn't mirror such a current during steady state conditions. Transistor 310 controls the current through transistor 302 so that the gate of cascode transistor 300 is biased to give a low steady state current.

Figure 4:
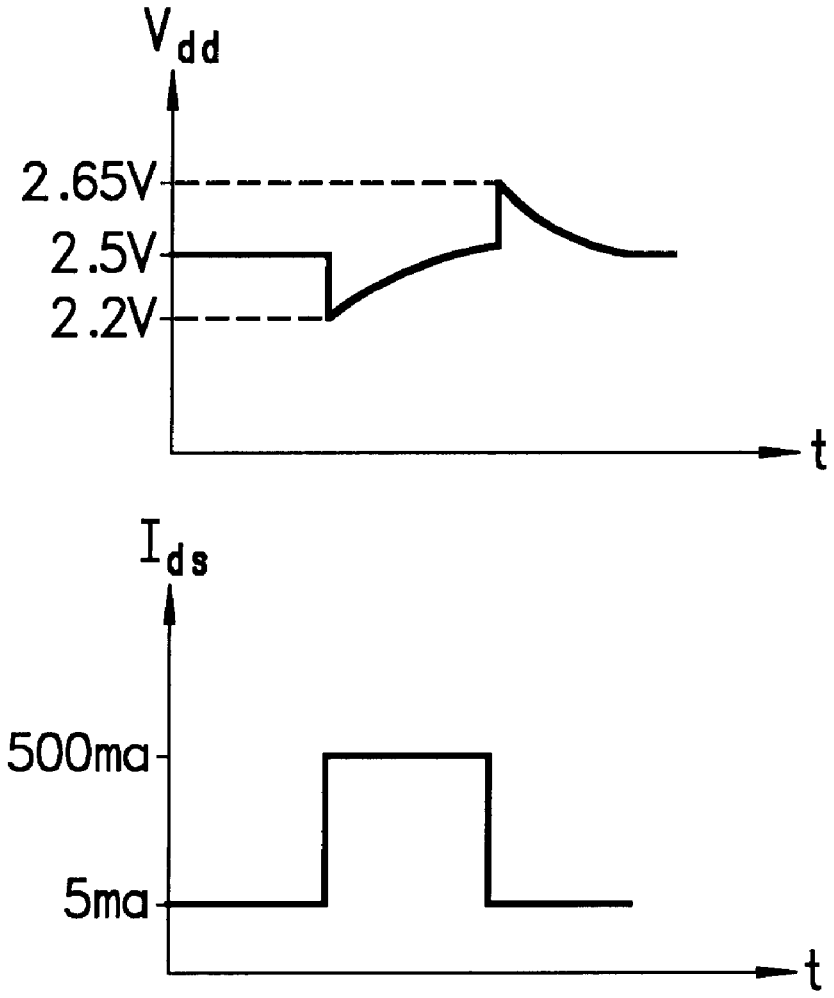
FIG. 4 plots voltage Vdd at node n2 vs. time and Ids of transistor 110 vs. time for the circuit of FIG. 3 when a load is applied and removed from node n2.

FIG. 4 illustrates how the voltage Vdd at node n2 and the drain to source current of transistor 110 are affected when a load is placed on node n2 when the circuitry of FIG. 3 is utilized. Initially the load is assumed to draw 5 milliamps, and the voltage Vdd remains stable at 2.5 volts. When the load is applied to node n2 which draws 500 ma, the current Ids of transistor 110 immediately increases to provide the 500 milliamps, and the voltage Vdd initially reduces to approximately 2.3 volts before the opamp 100 can react to increase Vdd back to 2.5 volts, similar to FIG. 2. When the 500 ma load is removed, the current Ids will return to 5 ma and the voltage Vdd will initially rise, but to a more limited degree with the circuitry of FIG. 3 (illustrated here as 2.65 volts as opposed to 2.8 volts in FIG. 2).

The present invention further includes a capacitor 320 connected from node n2 to the inverting input of the opamp 100 in parallel with resistor 102. The capacitor 320 provides a phase lead relative to the signal at node n2 to the inverting input of the opamp 100 to keep loop gain below 1 and avoid oscillations. The capacitor 320 also provides an immediate change at the inverting input of the opamp 100 when the node n2 voltage changes, enabling the opamp 100 to more quickly respond than a circuit with resistor 102 without such a capacitor.

To manufacture a circuit containing the resistor 102 and capacitor 320, the resistor 102 is formed by providing a p+diffusion region in a n type well. To create the capacitor, the n type well in which the resistor 102 is formed is simply tied to node n2.

Figure 5:
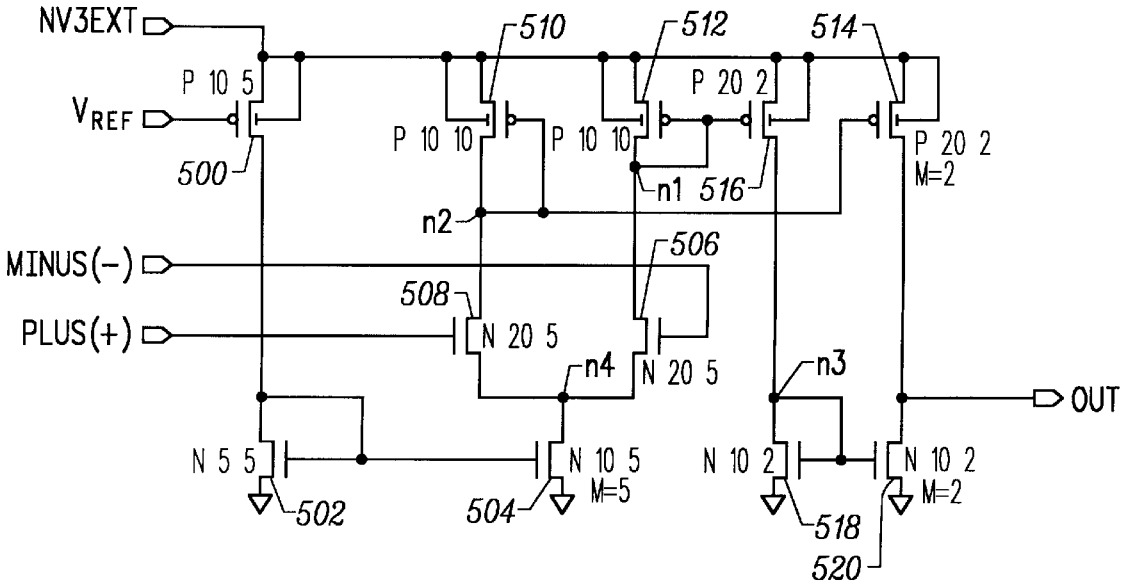
FIG. 5 shows circuitry for an opamp 100 of FIG. 3 as configured to use 2.5 volt semiconductor process transistors.

FIG. 5 shows circuitry for an opamp 100 of FIG. 3 as configured to use 2.5 volt semiconductor process transistors. The voltage VPREF, received by the opamp is set to the threshold voltage of a PMOS transistor (1 Vtp≈0.6V) below NV3EXT.

PMOS transistor 500 of the opamp has a source tied to NV3EXT, and a gate connected to VPREF. Transistor 500 will, thus, be a weak current source with NV3EXT and VPREF, having voltage values as described above. NMOS Transistor 502 has drain and gate connected to the drain of transistor 500, and a source connected to ground. Transistor 502 will sink the same current as transistor 500 and will likewise be weakly turned on with a 1 Vtn gate voltage.

Transistor 504 has a gate connected to the gate of transistor 502. Transistor 504 will, thus, mirror the current drawn by transistor 502, but transistor 504 is 10 times larger and will draw 10 times more current (m=5 indicates 5 transistor with a width of 10 microns for transistor 504, while transistor 502 has an 5 micron width).

NMOS transistors 506 and 508 have gates receiving the differential input for the opamp. Transistor 506 receives the inverting (−) input, and transistor 508 receives the noninverting (+) input. Transistors 506 and 506 have sources connected to the drain of transistor 504.

Transistor 510 has a gate and drain connected to the drain of transistor 508, so transistor 510 is biased by current from transistor 508. For example, if transistor 508 is drawing 10 microamps, transistor 510 which has a source connected to NV3EXT will source 10 microamps. Similarly, transistor 512 has a gate and drain connected to the drain of transistor 506, and a source connected to NV3EXT, so transistor 512 will source the same current which transistor 506 sinks.

In operation, we first assume that the noninverting (+) input of the opamp in FIG. 5 is higher than the inverting (−) input. Node n4 will go to the threshold of an NMOS transistor (1 Vtn) below the + input and all current to transistor 504 will be provided by transistor 508. Transistor 506 will turn off. Similarly, if the input is above the + input, transistor 508 will be off and transistor 506 will conduct to pull node n4 1 Vtn below the − input. For example, if the + input is 2.2 volts and the − input is 2.0 volts, transistor 508 will turn on to pull node n4 to 2.2 volts minus 1 Vtn and transistor 506 will be turned off. If the − input is 2.2 volts, and + input is 2.0 volts, transistor 506 will turn on to pull node n4 to 2.2 volts minus 1 Vtn and transistor 508 will turn off.

Transistor 514 has a gate connected to the gate of transistor 510 and a source connected to NV3EXT to form a current mirror. Similarly, transistor 516 has a gate connected to the gate of transistor 512 and a source connected to NV3EXT to form another current mirror. An additional current mirror is formed by transistors 518 and 520 which have gates connected together. Transistor 518 further has its gate and drain connected to the drain of transistor 516. The drain of transistor 520 is connected to the drain of transistor 514 to form the output (OUT) of the opamp. Sources of transistors 518 and 520 are connected to ground.

Assuming that the + input is above the − input, transistor 508 will be on and transistor 504 will sink current from transistor 510, while transistor 506 is off and transistor 512 has no path to ground. With no current through transistor 512, transistor 516 which mirrors the current of transistor 512, will provide no current. Since transistor 518 sinks the current transistor 516 sources, transistor 518 will carry no current. Since transistor 520 mirrors the current transistor 518 sinks, transistor 520 will sink no current. A path to ground from the output (OUT) will, thus, be cut off. With transistor 514 mirroring the current of transistor 510 and transistor 520 turned off, the output (OUT) will be pulled up to NV3EXT. Transistor 514 is sized approximately 4 times larger than transistor 510, so significant gain will be provided to assure the output (OUT) is high.

Similarly, if the − input is above the + input, transistor 506 will be on and transistor 504 will sink current from transistor 512, while transistor 508 will be off along with transistor 510. With transistor 510 off, transistor 514 will not source current to the output (OUT). With transistor 512 on, transistor 516 mirroring current from transistor 512, transistor 518 sinking the current sourced by transistor 512, and transistor 520 mirroring the current of transistor 518, transistor 520 will pull the output (OUT) to ground. Transistor 520 is significantly larger than transistor 518 and will sink a significant amount of current when transistor 518 is turned on to assure the output (OUT) is pulled down.

In summary, a small difference between the − input and the + input will cause a switching of the voltage on the output (OUT). If the − input and the + input are substantially equal, then the output (OUT) will be theoretically balanced.

The circuit of FIG. 5 is configured so that with 2.5 volt semiconductor process transistors, the gate to source and gate to drain voltages for the opamp transistors will not exceed a maximum of 2.7 volts. The voltage applied to the + and − inputs will preferably be 1.2 volts, and node n4 will be 1 Vtn below this or around 0.6 volts. Node n2 will be NV3EXT−1 Vtp since transistor 510 has its drain and gate connected together. With NV3EXT being a maximum of 3.6 volts, node n2 will be around 3.0 volts. With node n4 being around 0.6 volts, a maximum of 2.4 volts will be applied across transistors 506 and 508. Node n3 is 1 Vtn since transistor 518 has its gate and drain connected. The gate of transistor 516 being tied to the gate of transistor 512 will also be 1 Vtp below NV3EXT. The highest gate stress of transistor 516 will then be NV3EXT−1 Vtn−1 Vtp, or around 2.4 volts. The same conditions exist for transistor 514.

Figure 6:
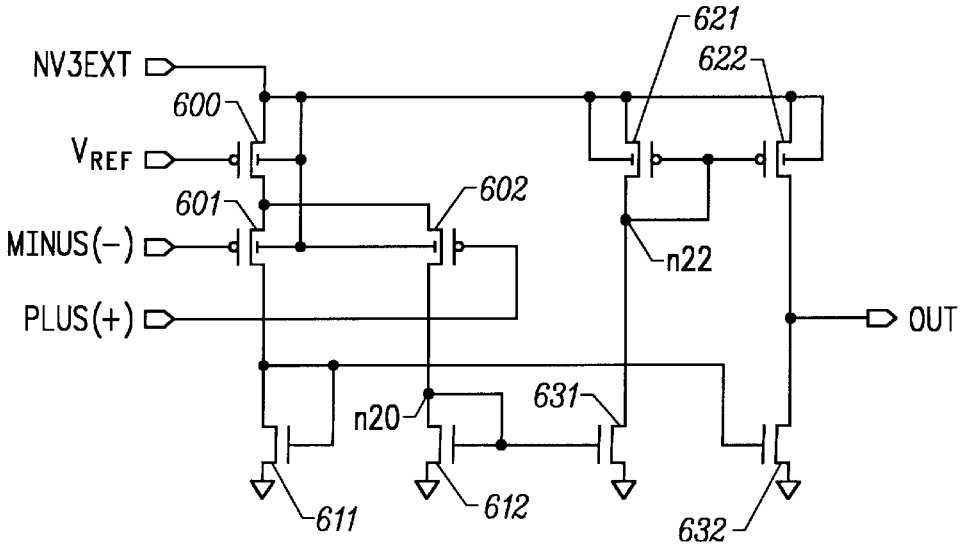
FIG. 6 shows an opamp circuit configuration could cause transistor gate oxide damage if used with 2.5 volt transistors in a power converter configuration of the present invention.

FIG. 6 shows an opamp circuit configuration which could cause transistor gate oxide damage if used with 2.5 volt transistors in a power converter configuration of the present invention. The opamp includes a weak PMOS current source 600 supplying current from the NV3EXT supply pin to node n23 at the source of PMOS transistors 601 and 602. The gates of transistors 601 and 602 are driven by the (−) and (+) to the opamp. An NMOS transistor 611 has a source connected to ground and its drain and gate are connected to the drain of transistor 601. An NMOS transistor 612 has a source connected to ground, and its drain and gate are connected to the drain of transistor 602. Transistor 611 forms a current mirror with an NMOS transistor 632, while transistor 612 forms a current mirror with NMOS transistor 631. PMOS transistors 621 and 622 form a current mirror and have sources connected to NV3EXT and drains supplying transistors 631 and 632. The gate of transistors 621 and 622 are connected to the drain of transistor 631. The common drains of transistors 622 and 632 form the opamp output.

In operation the source of transistors 621 and 622 will be at NV3EXT or a maximum of 3.6 volts, as indicated above. The gate of transistors 621 and 622 are tied to the drain of transistor 621, so that the drain of transistor 621 will be 1 Vtp below NV3EXT. With transistors 621 and 622 connected in a current mirror configuration, the drain of transistor 622 (OUT) will also be referenced by a fixed voltage to NV3EXT. With variations in NV3EXT, the value of (OUT) will, thus, change if the input voltages (+) and (−) remain fixed.

Assuming the opamp of FIG. 6 is included in the power converter circuit of FIG. 1, variations in the output of the opamp 100 will control transistor 110 to cause a similar variation in the inverting input (−) of the opamp 100. With $V_{DIOD}$ having a fixed value of approximately 1.2 volts, which is applied to the noninverting input (+), when NV3EXT varies the opamp of FIG. 6 will cause an input offset variation between the (−) and (+) inputs of the opamp. Such an input offset fluctuation with changes in NV3EXT will cause Vdd at node n2 in FIG. 1 to vary the value of Vdd with respect to ground. When using the opamp circuit shown in FIG. 6, sources of variation will add to other sources of variation and reduce the margin between Vdd and ground to create gate oxide stress in 2.5 volt transistors.

In FIG. 5, transistors 518 and 520 form a current mirror with their gates being connected to the source of transistor 518 at node n3, and their sources connected to ground. The drain of transistor 518 (OUT) will, therefore, be 1 Vtn above ground. Likewise, the drain of transistor 520 will be at a fixed voltage above ground, since transistors 518 and 520 are connected to form a current mirror. With variations in NV3EXT, the voltage at OUT will not change if the inputs to the opamp remain fixed.

The circuit of FIG. 5, therefore, provides an advantage over the circuit of FIG. 6 in a power converter configuration. With the circuit of FIG. 5 used in the power converter of FIG. 1, with variations in NV3EXT, the voltage output of the opamp 100 driving transistor 110 will not drift with changes in NV3EXT.

Although the present invention has been described above with particularity, this was merely to teach one of ordinary skill in the art how to make and use the invention. Many additional modifications will fall within the scope of the invention, as that scope is defined by the claims which follow.

What is claimed is:

1. A power converter comprising:

an operational amplifier having a noninverting input for receiving a voltage reference, an inverting input and an output, the operational amplifier comprising:

a first NMOS transistor having a gate providing the noninverting input, a source, and a drain;

a second NMOS transistor having a gate providing the inverting input, a source, and a drain;

a third NMOS transistor having a source coupled to a first voltage potential terminal, a drain coupled to the source of the first and second NMOS transistors, and having a gate;

a first PMOS transistor having a drain and gate coupled to the drain of the first NMOS transistor, and having a source coupled to a second voltage potential terminal;

a second PMOS transistor having a drain and a gate coupled to the drain of the second NMOS transistor, and having a source coupled to the second voltage potential terminal;

a third PMOS transistor having a source coupled to the second voltage potential terminal, a gate coupled to the gate of the first PMOS transistor, and having a drain;

a fourth PMOS transistor having a source coupled to the second voltage potential terminal, a gate coupled to the gate of the second PMOS transistor, and having a drain;

a fourth NMOS transistor having a source coupled to the first voltage potential terminal, and a drain and gate coupled to the drain of the fourth PMOS transistor; and a fifth NMOS transistor having a source coupled to the first voltage potential terminal, a gate coupled to the gate of the fourth NMOS transistor, and a drain coupled to the drain of the third PMOS transistor and to an output of the operational amplifier, wherein the fifth NMOS transistor comprises a plurality of parallel connected transistors forming a channel width larger than a channel width of the fourth NMOS transistor;

a first output control transistor having a source to drain path coupling a second voltage potential terminal to an output node, and having a gate coupled to the output of the operational amplifier; and a resistor divider comprising a first resistor coupling the output node to the inverting input of the operational amplifier, and a second resistor coupling the second input of the operational amplifier to the first voltage potential terminal.

2. A power converter comprising:

an operational amplifier having a noninverting input for receiving a voltage reference, an inverting input and an output, the operational amplifier comprising:

a first NMOS transistor having a gate providing the noninverting input, a source, and a drain;

a second NMOS transistor having a gate providing the inverting input, a source, and a drain;

a third NMOS transistor having a source coupled to a first voltage potential terminal, a drain coupled to the source of the first and second NMOS transistors, and having a gate;

a first PMOS transistor having a drain and gate coupled to the drain of the first NMOS transistor, and having a source coupled to a second voltage potential terminal;

a second PMOS transistor having a drain and a gate coupled to the drain of the second NMOS transistor, and having a source coupled to the second voltage potential terminal;

a third PMOS transistor having a source coupled to the second voltage potential terminal, a gate coupled to the gate of the first PMOS transistor, and having a drain;

a fourth PMOS transistor having a source coupled to the second voltage potential terminal, a gate coupled to the gate of the second PMOS transistor, and having a drain;

a fourth NMOS transistor having a source coupled to the first voltage potential terminal, and a drain and gate coupled to the drain of the fourth PMOS transistor; and a fifth NMOS transistor having a source cooled to the first voltage potential terminal, a date coupled to the gate of the fourth NMOS transistor, and a drain coupled to the drain of the third PMOS transistor and to an output of the operational amplifier;

a fifth PMOS transistor having a source coupled to the second voltage potential, a gate coupled to a voltage reference having a voltage value approximately at one threshold of a PMOS transistor below the second voltage potential, and having a drain;

a sixth NMOS transistor having a drain and gate coupled to the drain of the fifth PMOS transistor, and having a source coupled to the first voltage potential, the gate of the sixth NMOS transistor further being coupled to the gate of the third NMOS transistor;

a first output control transistor having a source to drain path coupling a second voltage potential terminal to an output node, and having a gate coupled to the output of the operational amplifier; and a resistor divider comprising a first resistor coupling the output node to the inverting input of the operational amplifier, and a second resistor coupling the second input of the operational amplifier to the first voltage potential terminal.

3. The power converter of claim 1, wherein the channel width of the fifth NMOS transistor is at least four times larger than the channel width of the fourth NMOS transistor.

4. The power converter of claim 1, wherein the third PMOS transistor is comprised of a plurality of parallel connected transistors so that channel width of the third PMOS transistor is larger than a channel width of the first PMOS transistor.

5. The power converter of claim 4, wherein the channel width of the third PMOS transistor is at least four times larger than the channel width of the first PMOS transistor.

6. The power converter of claim 2, wherein a channel width of the third NMOS transistor is comprised of a plurality of parallel connected transistors so that a channel width of the third NMOS transistor is larger than a channel width of the sixth NMOS transistor.

7. The power converter of claim 6, wherein the channel width of the third NMOS transistor is at least ten times larger than the channel width of the sixth NMOS transistor.

8. A power converter comprising:

an operational amplifier having a noninverting input for receiving a voltage reference, an inverting input and an output, the operational amplifier comprising:

a first NMOS transistor having a gate providing the noninverting input, a source, and a drain;

a second NMOS transistor having a gate providing the inverting input, a source, and a drain;

a third NMOS transistor having a source coupled to a first voltage potential terminal, a drain coupled to the source of the first and second NMOS transistors, and having a gate;

a first PMOS transistor having a drain and gate coupled to the drain of the first NMOS transistor, and having a source coupled to a second voltage potential terminal;

a second PMOS transistor having a drain and a gate coupled to the drain of the second NMOS transistor, and having a source coupled to the second voltage potential terminal;

a third PMOS transistor having a source coupled to the second voltage potential terminal, a gate coupled to the gate of the first PMOS transistor, and having a drain, wherein the third PMOS transistor is comprised of a plurality of parallel connected transistors so that a channel width of the third PMOS transistor is larger than twice a channel width of the first PMOS transistor;

a fourth PMOS transistor having a source coupled to the second voltage potential terminal, a gate coupled to the gate of the second PMOS transistor, and having a drain;

a fourth NMOS transistor having a source coupled to the first voltage potential terminal, and a drain and gate coupled to the drain of the fourth PMOS transistor; and a fifth NMOS transistor having a source coupled to the first voltage potential terminal, a gate coupled to the gate of the fourth NMOS transistor, and a drain coupled to the drain of the third PMOS transistor and to an output of the operational amplifier;

a first output control transistor having a source to drain path coupling a second voltage potential terminal to an output node, and having a gate coupled to the output of the operational amplifier; and a resistor divider comprising a first resistor coupling the output node to the inverting input of the operational amplifier, and a second resistor coupling the second input of the operational amplifier to the first voltage potential terminal.

9. The power converter of claim 8, wherein the channel width of the third PMOS transistor is at least four times larger than the channel width of the first PMOS transistor.

* * * * *

UNITED STATES PATENT AND TRADEMARK OFFICE

CERTIFICATE OF CORRECTION

PATENT NO. : 6,175,266 B1
DATED : January 16, 2001
INVENTOR(S) : Sharpe-Geisler

It is certified that error appears in the above-identified patent and that said Letters Patent is hereby corrected as shown below:

Column 1,
Line 44, delete "node n" and insert -- node n1 --.

Column 8, claim 2,
Line 49, delete "cooled" and insert -- coupled --.
Line 50, delete "date" and insert -- gate --.

Signed and Sealed this

Eighth Day of January, 2002

*Attest:*

JAMES E. ROGAN
*Attesting Officer*

*Director of the United States Patent and Trademark Office*